US005580273A

United States Patent [19]

Krieger et al.

[11] Patent Number: 5,580,273

[45] Date of Patent: Dec. 3, 1996

[54] HYDRAULIC ELECTRODE SEAL

[75] Inventors: Daniel J. Krieger, Peoria; John J. Krone, Dunlap, both of Ill.

[73] Assignee: Caterpillar Inc., Peoria, Ill.

[21] Appl. No.: 439,236

[22] Filed: May 11, 1995

[51] Int. Cl.[6] ..... H01R 13/74

[52] U.S. Cl. ..... 439/546; 439/926; 174/65 SS

[58] Field of Search ..... 439/546–548, 439/550, 559, 564, 572, 573, 587, 908, 926; 174/65 R, 65 SS, 153 R

[56] References Cited

U.S. PATENT DOCUMENTS

| | | | |
|---|---|---|---|
| 3,249,907 | 5/1966 | Hewitson | 339/60 |
| 3,609,639 | 9/1971 | Lind | 339/89 |
| 3,624,585 | 11/1971 | Kokalas et al. | 339/16 |
| 3,750,088 | 7/1973 | Berian | 339/94 |
| 3,861,778 | 1/1975 | Capra | 339/103 |
| 4,114,974 | 9/1978 | Lawrence | 339/103 |
| 4,609,239 | 9/1986 | Abel et al. | 339/15 |
| 4,834,675 | 5/1989 | Samchisen | 439/578 |
| 5,062,810 | 11/1991 | Kroll | 439/589 |
| 5,139,639 | 8/1992 | Holleboom | 204/427 |
| 5,299,951 | 4/1994 | Blaetz | 439/367 |
| 5,310,359 | 5/1994 | Chadbourne et al. | 439/462 |

OTHER PUBLICATIONS

Conax Buffalo "EGT Glands Electrode Sealing" Spec Sheet, p. 16, Issued Feb. 1993.

*Primary Examiner*—Gary F. Paumen
*Attorney, Agent, or Firm*—J. W. Burrows

[57] ABSTRACT

The subject arrangement provides a compact leak free mechanism to interconnect an electrical signal between the interior and exterior of a pressure vessel. The electrode sealing arrangement of the subject invention includes a housing, an insulating sealant material member having an enlarged portion with an electrical conducting electrode disposed through the insulating sealant material member, a collar mechanism, and a force transferring mechanism operative to apply a force through the collar mechanism to compress the insulating sealant material member against the housing and the electrical conducting electrode. The force being applied to the enlarged portion compresses it and seals the components from leakage and exerts a holding force on the electrical conducting electrode thus holding it in its assembled position.

5 Claims, 2 Drawing Sheets

HYDRAULIC ELECTRODE SEAL

DESCRIPTION

1. Technical Field

This invention generally relates to a seal for an electrical connection and more particularly to a retaining and sealing arrangements to provide an electrical pathway between the inside of chamber of a pressure vessel and the exterior thereof.

2. Background Art

Various attempts have been made to connect electrical energy between areas that are incompatible due to the presence of electrically conducting components or sealed containers. Some known arrangements have used various forms of rubber coatings or insulators while others have used connector pin assemblies. The pin assemblies normally have one part of the pin assembly mounted in a non-inductor material on one side of the conductive material and the other part of the pin assembly being engagable with the first part and mounted in a non-inductor material on the other side of the conductive material. Other arrangements have used a straight one piece electrode surrounded by a non-conductive material and held in place by a force being applied to the non-conductive material. These available arrangements are normally larger in size and the one straight one piece electrode is not securely held in place when being subjected to large pressure levels.

The subject invention is directed to overcoming one or more of the problems as set forth above.

DISCLOSURE OF THE INVENTION

In one aspect of the present invention, an electrode sealing arrangement is provided and adapted for providing a sealed electrical pathway between an interior cavity of a pressure vessel and the exterior thereof. The electrode sealing arrangement includes a housing, an insulating sealant material member, a collar mechanism, a force transferring mechanism and an electrical conducting electrode. The housing has a stepped bore therethrough and is adapted for connection to the pressure vessel. The stepped bore has first and second inner diameters with a tapered shoulder disposed therebetween. The insulating sealant material member has a first outer diameter at one end thereof operative to fit into the first inner diameter of the stepped bore, an enlarged portion, a second outer diameter at the other end thereof, and a bore extending through the length thereof. The enlarged portion has a first tapered shoulder operative to mate with the tapered shoulder in the stepped bore, a second opposed tapered shoulder, and an outer diameter operative to fit into the second inner diameter of the stepped bore. The collar mechanism has a bore therethrough and a tapered surface adjacent one end of the through bore and is operatively disposed about the second outer diameter of the insulating sealant material member and the tapered surface being engagable with the second The opposed tapered shoulder of the enlarged portion. The force transferring mechanism is attached to the housing and operative to apply a force to the collar mechanism and subsequently to the enlarged portion of the insulating sealant material member. The electrical conducting electrode is disposed in the bore of the insulating sealant material member and extends therethrough.

BEST MODE FOR CARRYING OUT THE INVENTION

Figure 1:
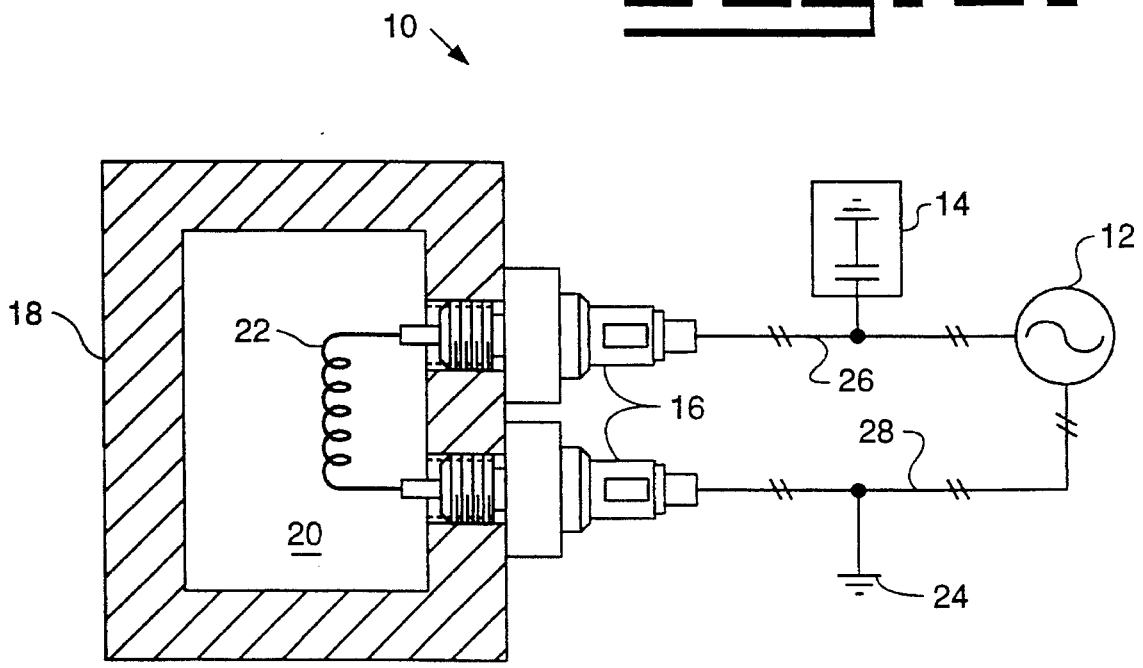
FIG. 1 is a diagrammatic representation of electrical system incorporating an embodiment of the present invention.

Referring to FIG. 1 of the drawings, an electrical system 10 is illustrated and includes a source of electric energy, such as a voltage generator 12, a capacitor 14, two electrode sealing arrangements 16, a pressure vessel 18 having an interior cavity 20, an inductor 22, and a ground connection 24. The two electrode sealing arrangements 16 are threadably mounted on the pressure vessel 18 and connected to the voltage source 12 and the ground connection 24 by electrical lines 26,28. The inductor 22 is disposed within the interior cavity 20 of the pressure vessel 18 and connected between the two electrode sealing arrangements 16.

Each of the two electrode sealing arrangements 16 are identical. The following description describes only one of them. Each of the electrode sealing arrangement 16 includes a housing 30, an insulating sealant material member 32, a collar mechanism 34, a force transferring mechanism 36, and an electrical conducting electrode 38.

The housing 30 has a stepped bore 40. The stepped bore 40 defines a first inner diameter 42 at one end thereof, a second larger diameter 44 with a tapered shoulder 46 located therebetween, and a threaded diameter 48. An external thread 50 is disposed on the housing and operative to threadably mount the housing 30 to the pressure vessel 18.

The insulating sealant material member 32 has a first outer diameter 56 on one end thereof, an enlarged portion 58 having a larger outer diameter 60 and is adjacent the first outer diameter 56, a second outer diameter 62 on the other end thereof, and a bore 64 defined therein and extending therethrough. A first tapered shoulder 66 is disposed on the insulating sealant material member 32 between the first outer diameter 56 and the larger outer diameter 60. A second tapered shoulder 68 is disposed on the insulating sealant material member 32 between the second outer diameter 62 and the enlarged outer diameter 60.

In the subject embodiment, the collar mechanism 34 is a sleeve 70. The sleeve 70 has an outer diameter 72, first and second ends 74,76, and a bore 78 extending therethrough. A tapered surface 80 is disposed at the one end 74 thereof and operative to engage the second tapered shoulder 68 of the insulating sealant material member 32. The through bore 78 of the sleeve 70 is operative to receive the second outer diameter 62 of the insulating sealant material member 32.

The force transferring mechanism 36 of the subject embodiment is a threaded cap member 81 having an external thread 82, a first bore 84, and a second larger bore 86 with a shoulder 88 interconnecting the first and second bores 84,86 thereof. The first bore 84 of the threaded cap member 81 is operative to receive the second outer diameter 62 of the insulating sealant material member 32 and the second bore 86 thereof is operative to receive the outer diameter 72 of the sleeve 70. The external thread 82 of the threaded cap member 81 is operatively disposed in the threaded diameter 48 of the housing 30 and the shoulder 88 thereof urgingly contacts the second end 76 of the sleeve 70.

The electrical conducting electrode 38 of the subject embodiment has a first diameter 90 and an enlarged portion 92 at one end thereof and is operatively disposed adjacent the first outer diameter 56 of the insulating sealant material member 32. The enlarged portion 92 is adapted for connection with the inductor 22 and the other end thereof is adapted for connection with the appropriate electrical lines 26,28.

Figure 2:
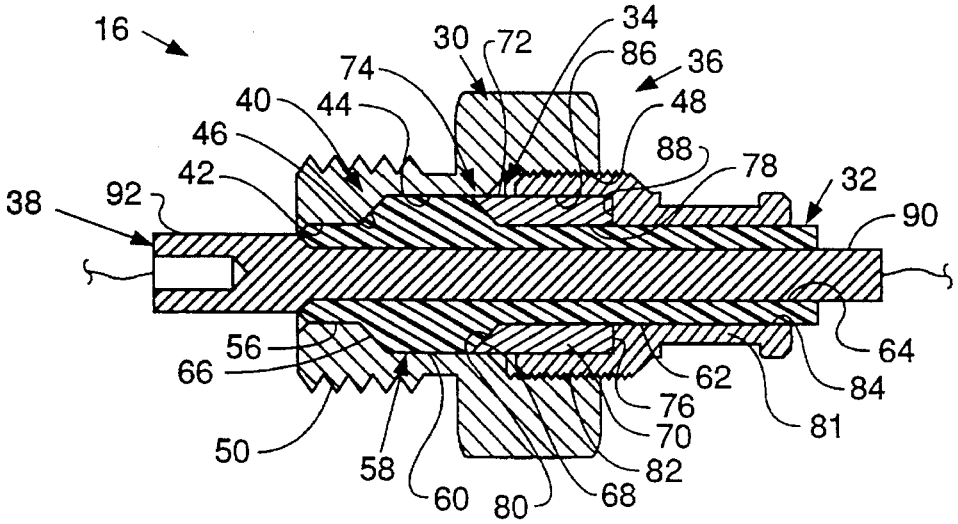
FIG. 2 is a cross-sectional view of one embodiment of the present invention.
Figure 3:
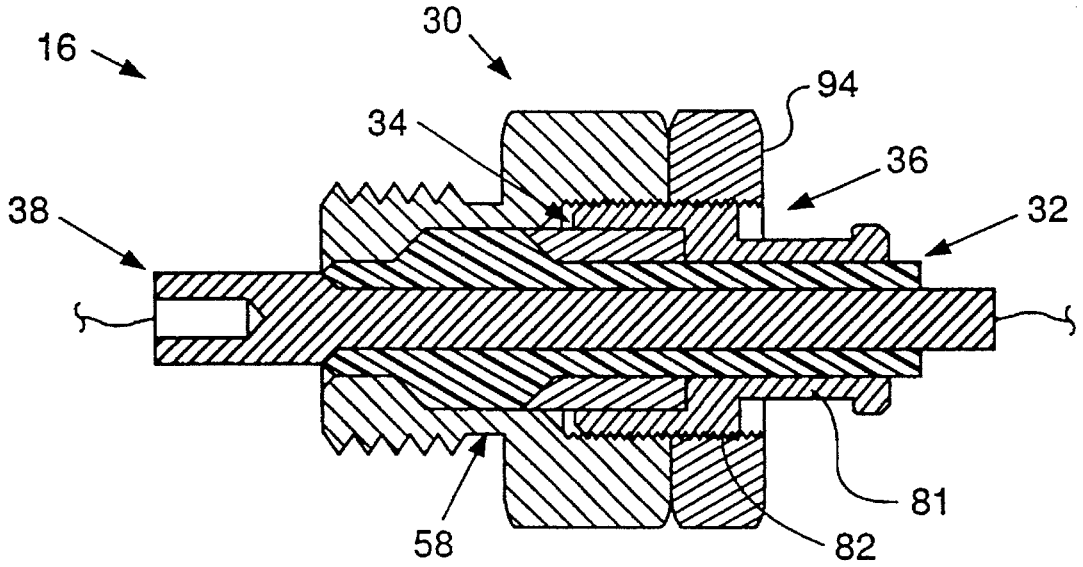
FIG. 3 is a cross-sectional view of another embodiment of the present invention.

Referring to FIG. 3, another embodiment of the subject invention is illustrated. The embodiment of FIG. 3 is substantially the same as the embodiment of FIG. 2. Like elements have like element numbers. In FIG. 3, the external thread 82 of the threaded cap member 81 extends the entire length of the outermost diameter. The embodiment of FIG. 3 includes a threaded lock nut 94 operative to threadably engage the external thread 82 of the threaded cap member 81 and abut the housing 30 to lock the threaded cap member 81 relative to the housing 30.

Figure 4:
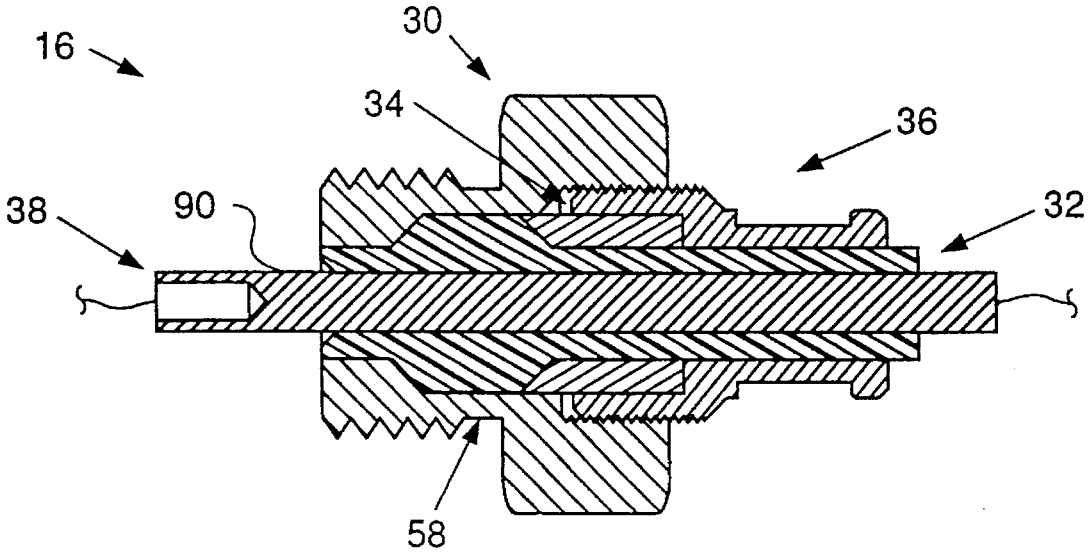
FIG. 4 is a cross-sectional view of yet another embodiment of the present invention.

Referring to FIG. 4, another embodiment of the subject invention is illustrated. The embodiment of FIG. 4 is substantially the same as the embodiment of FIG. 2. Like elements have like element numbers. The electrical conducting electrode 38 of FIG. 4 does not have an enlarged end portion 92. The diameter 90 extends the full length thereof.

It is recognized that various forms of the electrode sealing arrangement 16 could be utilized without departing from the essence of the invention. For example, it is recognized that the collar mechanism 34 and the force transferring mechanism 36 could be a common integral mechanism. Likewise, the housing 30 could be mounted to the pressure vessel 18 in other know ways. The inductor 22 disposed within the pressure vessel 18 could be any type of connection requiring an electrical pathway between the inside of the pressure vessel 18 and the outside thereof. The pressure vessel 18 could be any type of vessel that is subjected to internal pressures or internal vacuums.

INDUSTRIAL APPLICABILITY

In the operation of the subject invention of FIG. 1, an electrical pathway is needed between the inductor 22 disposed within the interior 20 of the pressure vessel 18 and the source of electrical energy 12 and the ground connection 24 located outside of the pressure vessel 18. In FIG. 1, two electrode sealing arrangements 16 are illustrated. It is recognized that in some arrangements only one electrode sealing arrangement 16 would be required.

Referring to the assembly and operation of the electrode sealing arrangement 16 of FIG. 2, the diameter 90 of the electrical conducting electrode 38 is disposed in the through bore 64 of the insulating sealant material member 32 with the enlarged end portion 92 being located adjacent the first outer diameter 56 of the insulating sealant material member 32. The first outer diameter 56 of the insulating sealant material member 32 is slipped into the first inner diameter 42 of the housing 30 so that the first tapered shoulder 66 thereof contacts the tapered shoulder 46 of the housing 30. The sleeve 70 is slipped over the second outer diameter 62 of the insulating sealant material member 32 until the tapered surface 80 at the one end 74 contacts the second tapered shoulder 68 of the insulating sealant material member 32. The external thread 82 of the threaded cap member 81 is screw threadably engaged in the threaded diameter 48 of the housing 30. It is recognized that the thread engagement of the subject embodiment would be an interference fit. As the threaded cap member 81 threadably advances into the housing 30, the shoulder 88 thereof contacts the second end 76 of the sleeve 70 urging the sleeve 70 against the second tapered shoulder 68 of the insulating sealant material member 32. Since the first and second tapered shoulders 66,68 of the enlarged portion 58 is trapped between the tapered shoulder 46 of the housing 30 and the tapered surface 80 of the sleeve 70, the enlarged portion 58 thereof is forced to compress. The forces acting on the material in the enlarged portion 58 compresses the material firmly against the outer diameter 90 of the electrical conducting electrode 38. The compressive forces of the material in the enlarged portion 58 acting on the outer diameter 90 of the electrical conducting electrode 38 holds the electrical conducting electrode 38 in its assembled position. Likewise, the forces acting on the enlarged portion 58 effectively seals the components relative to each other thus blocking leakage of pressurized fluid from the pressure vessel 18. By having the retaining forces being transferred through both the tapered shoulder of the housing 30 and the tapered surface 80 of the sleeve 70 to the respective first and second tapered shoulders 66,68 of the insulating sealant material member 32, larger sealing and retaining forces are induced into the enlarged portion 58 and subsequently to the outer diameter 90 of the electrical conducting electrode 38. The electrical conducting electrode 38 is further inhibited from being forced out due to pressure within the interior 20 acting thereon by the enlarged end portion 92 being in contact with the end of the insulating sealant material member 32 adjacent the first outer diameter 56 thereof. The subject arrangement provides an electrical pathway from the interior cavity 20 of the pressure vessel to the exterior thereof free of leakage of pressurized fluid therefrom. The larger forced induced into the enlarged portion 58 enables the subject arrangement to operate at higher pressure levels.

Referring to the assembly and operation of FIG. 3, the assembly and operation is substantially the same as that of FIG. 2. In order to ensure that the threaded cap member 81 is firmly secured in the housing 30, the threaded lock nut 94 is threaded on the external thread 82 and tightened against the housing 30 to firmly lock the threaded cap member 81 with respect to the housing 30 once the assembly has been properly tightened.

Referring to the assembly and operation of FIG. 4, the assembly and operation is substantially the same as that of FIG. 2. The only difference in FIG. 4 is that the electrical conducting electrode 38 is a straight member and does not have the enlarged portion 92. The electrical conducting electrode 38 is secured in its assembled position by the compressive forces induced thereto through the enlarged portion 58 of the insulating sealant material member 32.

In view of the foregoing, it is readily apparent that the electrode sealing arrangement 16 of the present invention provides a simple and effective arrangement to connect an electrical pathway between the interior 20 of a pressure vessel 18 and the exterior thereof free of leakage of the pressurized fluid within the pressure vessel 18. The subject arrangement also firmly secures the electrical conducting electrode 38 within the housing 30 against forces within the interior cavity 20 acting to push it out.

We claim:

1. An electrode sealing arrangement adapted for providing a sealed electrical pathway between an interior cavity of a pressure vessel and the exterior thereof, comprising:

a housing having a stepped bore therethrough and being adapted for connection to the pressure vessel, the stepped bore having first and second inner diameters with a tapered shoulder disposed therebetween;

an insulating sealant material member having a first outer diameter at one end thereof operative to fit into the first inner diameter of the stepped bore, an enlarged portion, a second outer diameter at the other end thereof, and a bore extending through the length thereof, the enlarged portion having a first tapered shoulder operative to mate with the tapered shoulder in the stepped bore, a second opposed tapered shoulder, and an outer diameter operative to fit into the second inner diameter of the stepped bore;

a collar mechanism having a bore therethrough and a tapered surface adjacent one end of the through bore and being operatively disposed about the second outer diameter of the insulating sealant material member and the tapered surface being engagable with the second opposed tapered shoulder of the enlarged portion;

a force transferring mechanism attached to the housing and operative to apply a force to the collar mechanism and subsequently to the enlarged portion of the insulating sealant material member; and an electrical conducting electrode disposed in the bore of the insulating sealant material member and extending therethrough.

2. The electrode sealing arrangement of claim 1 wherein the housing has a threaded inner diameter adjacent the second inner diameter thereof, the collar mechanism is a metal sleeve, and the force transferring mechanism is a threaded cap member.

3. The electrode sealing arrangement of claim 2 wherein the metal sleeve has an outer diameter, the bore extending therethrough, the tapered surface adjacent the through bore, and a second end, and the threaded cap member has an external thread operative to mate with the threaded inner diameter of the housing, a first bore operative to receive the outer diameter of the metal sleeve, a second bore operative to receive the second outer diameter of the insulating sealant material member, and a shoulder disposed between the first and second bores and operative to engage and transfer force to the second end of the metal sleeve.

4. The electrode sealing arrangement of claim 3 wherein the electrical conducting electrode has an enlarged portion extending from the end thereof adjacent the first inner diameter of the housing and being adapted for insertion into the pressure vessel.

5. The electrode sealing arrangement of claim 3 including a threaded lock nut operative to threadably engage the external thread of the cap member and lock the cap member relative to the housing.

* * * * *